US005254177A

United States Patent [19]

Chauvin

[11] Patent Number: 5,254,177

[45] Date of Patent: Oct. 19, 1993

[54] METHOD AND SYSTEM FOR DISPOSING OF CONTAMINATED PARAFFIN WAX IN AN ECOLOGICALLY ACCEPTABLE MANNER

[75] Inventor: Carl J. Chauvin, Chauvin, La.

[73] Assignee: Paraffin Solutions, Inc., Baton Rouge, La.

[21] Appl. No.: 833,047

[22] Filed: Feb. 10, 1992

[51] Int. Cl.[5] ..... B08B 9/00

[52] U.S. Cl. ..... 134/8; 208/24; 208/370; 134/6; 134/7; 137/13

[58] Field of Search ..... 208/370, 24; 134/8

[56] References Cited

U.S. PATENT DOCUMENTS

| | | | |
|---|---|---|---|
| Re. 30,281 | 5/1980 | Tackett et al. | 137/13 |
| 1,380,798 | 6/1921 | Hansen et al. | 415/197 |
| 1,832,827 | 11/1931 | Youngblood | 366/272 |
| 2,205,096 | 6/1940 | Jenkins | 196/18 |
| 2,303,823 | 12/1942 | Coberly | 196/1 |
| 3,129,164 | 4/1964 | Cameron | 208/8 |
| 3,269,401 | 8/1966 | Scott et al. | 137/13 |
| 3,292,647 | 12/1966 | Scott | 137/1 |
| 3,561,822 | 2/1971 | Gaylord et al. | 302/14 |
| 3,607,400 | 9/1971 | Goins | 134/8 |
| 3,630,212 | 12/1971 | Martin | 134/22 |
| 3,677,476 | 7/1972 | Harned | 241/21 |
| 3,759,836 | 9/1973 | Collins et al. | 252/309 |
| 3,804,752 | 4/1974 | Merrill et al. | 208/370 |
| 3,846,279 | 11/1974 | Merrill, Jr. | 208/93 |
| 3,853,356 | 12/1974 | Merrill, Jr. | 208/370 |
| 3,900,041 | 8/1975 | Kersch et al. | 208/370 |
| 3,900,391 | 8/1975 | Merrill et al. | 208/370 |
| 4,013,544 | 3/1977 | Merrill, Jr. | 208/93 |
| 4,054,507 | 4/1976 | Pouska | 208/24 |
| 4,263,926 | 4/1981 | Drake et al. | 137/13 |
| 4,309,269 | 1/1982 | Denker et al. | 208/8 LE |
| 4,335,964 | 6/1982 | Drake et al. | 366/114 |
| 4,579,563 | 4/1986 | Burnside et al. | 44/51 |
| 4,681,508 | 7/1987 | Kim | 415/116 |
| 4,758,246 | 7/1988 | Burnside et al. | 44/51 |
| 4,895,602 | 1/1990 | Sagawa | 134/8 |

FOREIGN PATENT DOCUMENTS 3247406 12/1982 Fed. Rep. of Germany .

*Primary Examiner*—Helane Myers

*Attorney, Agent, or Firm*—Dougherty, Hessin, Beavers & Gilbert

[57] ABSTRACT

A method of treating blocks of waste paraffin wax entailing initially subdividing the wax into particles less than one cubic inch in size, and preferably in elongated string or rod form, then intimately mixing the particles with a viscous hydrocarbon liquid in a first mixing zone by agitation. The mixture is passed through a centrifugal pump where further mixing and further comminution of the wax particles occurs as a result of cavitation and pump impeller impact. A slurry of wax in hydrocarbon is discharged from the centrifugal pump and recycled at least once back through the first mixing zone and then back to the pump.

14 Claims, 3 Drawing Sheets

METHOD AND SYSTEM FOR DISPOSING OF CONTAMINATED PARAFFIN WAX IN AN ECOLOGICALLY ACCEPTABLE MANNER

FIELD OF THE INVENTION

The present invention pertains to a waste hard paraffin wax disposal method wherein chunks of the wax are comminuted to particles which are small enough to permit them to be slurried in oil, and thereby entrained in oil flowing in a pipeline.

BACKGROUND OF THE INVENTION

The disposal of hard paraffin wax collected from pipelines during cleaning and pigging has become increasingly difficult due to legal restrictions imposed by various governmental authorities, and the desire to minimize environmental damage. This problem of wax disposition is aggravated where the acceptable disposal of paraffin wax requires transport of the paraffin to a suitable landfill or storage facility located at a substantial distance from its point of initial collection. Moreover, recent legislation has lowered the acceptable threshold level of benzene in a hydrocarbon waste material, below which level such material can continue to be classified as an industrial waste (as opposed to a hazardous waste). Thus, the new maximum benzene concentration which will allow the material in which the benzene is contained to be classified as an industrial waste is 0.5 ppm.

Paraffin wax which is scraped from the interior of pipelines during the cleaning of the pipeline, using a pig or the like, is in the form of hydrocarbon-containing blocks or chunks of wax. In most instances, such recovered wax has a benzene level above the new maximum limit of 0.5 ppm, and therefore is now classified as a hazardous waste. By government regulations, the options available for environmentally acceptable disposition of a hazardous waste are fewer and are generally substantially more expensive than those which are available in the case of material classified as an industrial non-hazardous waste. In sum, the escalating costs of disposal, and heightened environmental sensitivity, provide significant impetus to the examination and identification of practical new alternative disposal procedures by which the wax can be disposed of in an environmentally acceptable way.

The method currently in use for disposing of relatively hard waste paraffin wax collected in the course of pipeline clean outs or the like is to simply collect it in a number of suitable containers (such as barrels) located at a suitable place. Here the paraffin will, under optimum conditions, be retained without leakage or loss so as to pollute or contaminate the environment. This is not a true solution to the problem of disposal, however, because the original possessor of the barrel-contained wax, confronted with the problem of disposition, now has continuing and unlimited exposure from the wax retained in the barrels.

It is to the end of providing a more acceptable alternative method of disposition of such waste paraffin wax that the present invention is directed. The method of the present invention undertakes to dispose of hard paraffin wax collected from the pipeline during the cleaning process and in an economically attractive way in that the wax is substantially entirely converted to useful product. The proposed method of wax disposition does not pose an environmental hazard. Considering that the wax, as it is pigged from a pipeline during cleaning, is unsuitable for re-use, reclamation or sale in the state in which it then exists, the method of this invention is therefore particularly attractive since it provides both a financial advantage, and it alleviates a severe environmental contamination concern.

SUMMARY OF THE INVENTION

The present invention provides a unique method for the disposal of chunks or blocks of hard paraffin wax which are contaminated with hydrocarbons and some dirt as such paraffin wax is recovered from the internal walls of a pipeline in use for conveying crude oil or the like. Such contaminated wax is derived from the pipeline walls in the process of cleaning the pipeline by the use of a pipeline pig. By hard paraffin wax is meant free standing solid wax which will not collapse or flow under gravitational influence.

In accordance with the process of the present invention, the paraffinic matter (defined as hard paraffin wax with hydrocarbon contaminants) is collected from the interior of a pipeline at one or more pig traps therealong, or in two or more pipelines, and is then comminuted by extrusion into small strands, and is then mixed with oil from the pipeline from which it is removed, or with a hydrocarbon mixture similar in viscosity and content to that oil. The mixture is then conveyed through a centrifugal pump so that the paraffin wax (through the initial extrusion step, and the centrifugation-cavitation occurring subsequently in the centrifugal pump) is reduced to very small particles which are slurried or suspended in the oil carrier fluid. This slurry composition is then pumped back into an existing pipeline and mixed with the oil flowing in the pipeline. Such oil is preferably the same, or is close, in chemical and physical characteristics to the oil with which the comminuted wax is mixed. The wax-oil slurry is then transported in the oil flowing through the pipeline to the refinery constituting the destination of the oil where it is subjected to the ordinary and usual refining processes to which such oil is subjected. This method thus eliminates the need for off-site transportation and storage of the paraffin wax.

Those skilled in the art of pipeline cleaning, and familiar with the described paraffin matter accumulation problem, will recognize the advantages of the method of the present invention as certain of the advantages have been described above, and as others are comprehended without express description here. The skilled artisan will further appreciate the superior features of the invention in comparison to the types of disposal methods previously in use, and these will become manifest as the following detailed description of a preferred embodiment of the invention is read in conjunction with the accompany drawing.

BRIEF DESCRIPTION OF THE DRAWINGS

FIG. 5 is a side elevation view of a mixing tank for supplying oil and paraffin wax particles to a centrifugal pump, the discharge of which is connected by a valve so as to optionally recirculate paraffin laden oleaginous liquid within the illustrated system, or alternatively, to discharge the paraffin laden liquid to an injection pump from which the viscous slurry of paraffin in oil can be injected into a pipeline carrying a regular flow of crude petroleum or the like.

DETAILED DESCRIPTION OF A PREFERRED EMBODIMENT OF THE INVENTION

Figure 1:
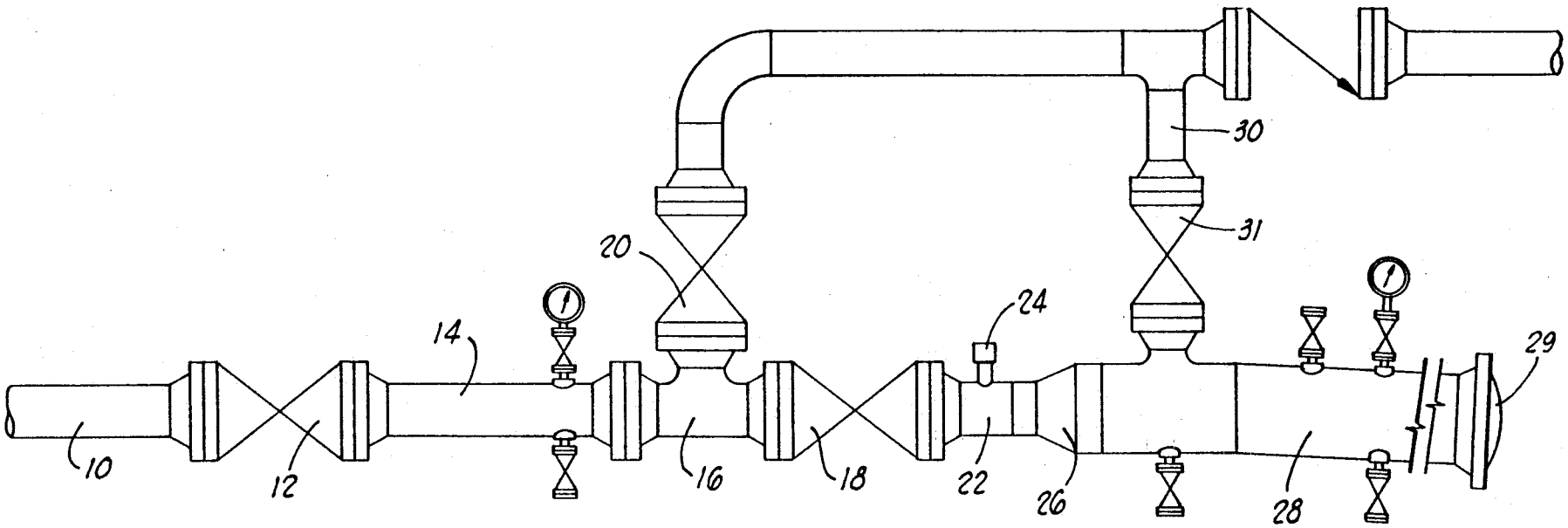
FIG. 1 is a diagram illustrating a typical pipeline pig trap or receiver layout, as such is utilized in the entrapment and accumulation of paraffin wax pigged out of a pipeline during its cleaning.

In the description which follows, identical structural parts are marked throughout the specification and the drawings with identical reference numerals. The structures illustrated in the drawings are not necessarily to scale, and certain features may be shown in schematic form in the interest of clarity and conciseness. Referring initially to FIG. 1, the configuration of a pipeline pig trap located in a crude oil pipeline is illustrated. In the cleaning of a pipeline by the use of a mechanical pig, a pig which is generally described as a short cylindrical block having an annular squeegee flange around its outer periphery which is of greater diameter than the inside diameter of the pipeline, is passed through the pipeline under the impress of a hydraulic or pneumatic driving force. As such pig moves through the pipeline, the annular scraper blade or squeegee carried around its outer periphery scrapes against the inside wall of the pipeline. In doing so, it scrapes away paraffin wax accumulated on the interior of the pipeline and to be removed to the maximum extent possible in the course of the cleaning process. After the pig has typically moved several miles through the pipeline, a substantial amount of the removed paraffinic matter is disposed ahead of the pig and is moved by it through the pipeline.

Often, though not always, the removed wax is hard and appears as chunks or blocks. Occasionally it is soft and is of a greasy, sticky consistency.

In the described context of the cleaning of a pipeline by a mechanical pig, the oil flow may be considered as moving from left to right in the pig trap structure illustrated in FIG. 1. Thus, crude oil, for example, flows through the pipeline 10, through the valve 12, through the pipeline section 14 and through a T-fitting 16 forming a part of the pig trap. In line with the pipeline 10 and to the right of the T-fitting 16 is a blocking valve 18. A second blocking valve 20 is also connected to the T-fitting 16.

During operation, when the blocking valve 20 is closed and the blocking valve 18 is open, the pig, pushing large globs and chunks of paraffin ahead of it, will pass through the blocking valve 18, and then through the line sub or short section 22 where its passage actuates a pig signal 24, and on through an enlarging section 26. The pig and the paraffin will then pass through enlarged diameter T-fitting 27 and on into the enlarged diameter pig trap section 28 as lateral flow through the line 30 is prevented by the closed blocking valve 31. The pig trap section 28 is closed by a removable closure plate 29.

By proper manipulation of the blocking valves and other valves associated with the pig trap assembly depicted in FIG. 1, the pig and the paraffin moved along ahead of it are caught in the enlarged section 28 which is typically about 20 feet in length and can hold 8 or 9 barrels of crude oil. The pig, per se, may be of varying length as is well understood in the art. Blocks or chunks of hard paraffin which are scraped from the inner walls of the pipe and moved into the trap ahead of the pig can be from about ten inches to about eighteen inches in length. Such paraffinic matter which consist predominantly of paraffin wax, but which also includes some hydrocarbon liquids and a small amount of inorganic debris, can then be removed from the trap section 28 after removal of the closure plate 29 and following closure of the valve 18 and opening of the valve 20. After removal from the trap, the wax is loaded into barrels, drums or other containers suitable for transporting the paraffin wax to an adjacent processing system constructed in accordance with the present invention.

Figure 2:
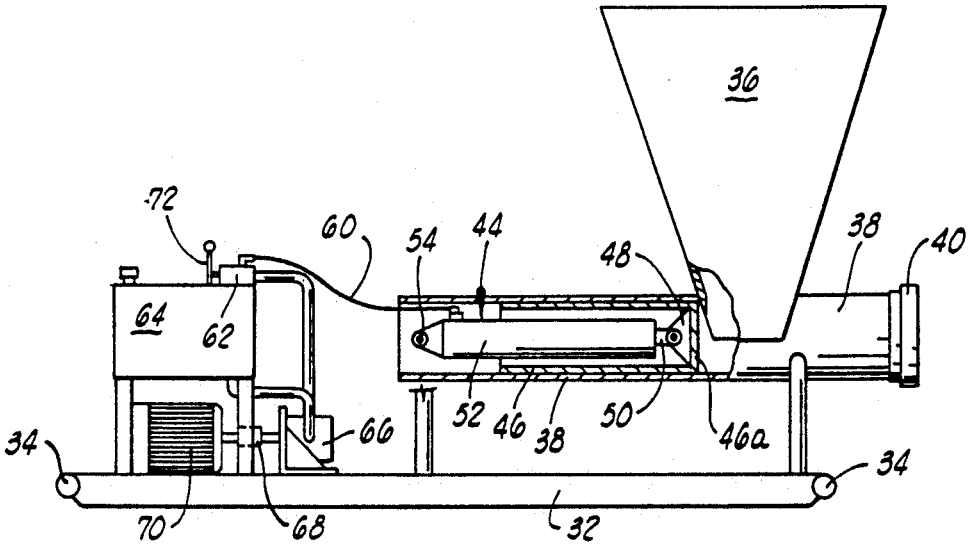
FIG. 2 is a side elevation view of a feed hopper and hydraulic extruder apparatus which is utilized to receive the chunks and blocks of paraffin matter after their collection in one or more pig traps, and to hydraulically extrude such chunks and blocks through a cutter ring and screen.
Figure 3:
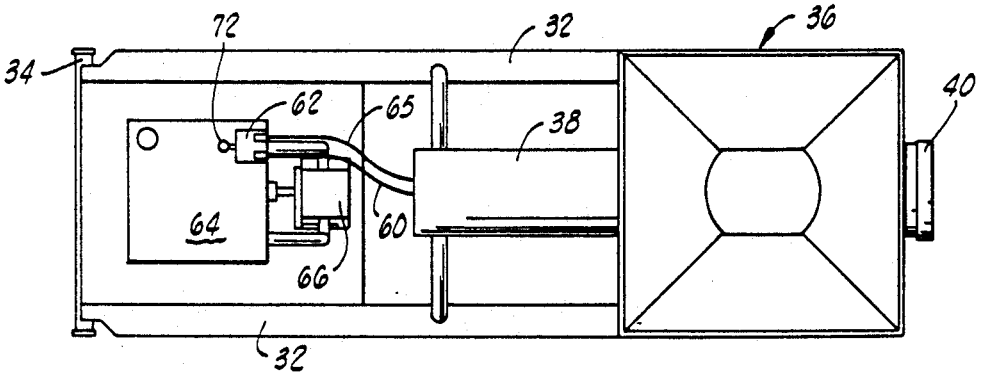
FIG. 3 is a top plan view of the hopper and hydraulic extruder apparatus depicted in FIG. 2.
Figure 4:
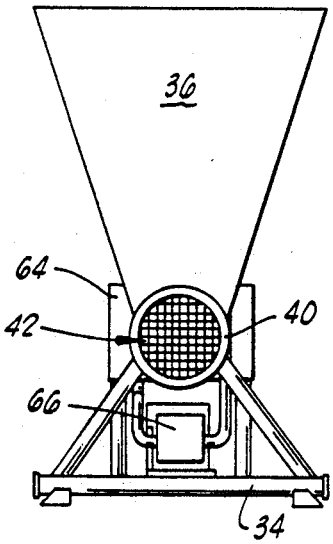
FIG. 4 is an end elevation view of the hopper and extruder apparatus illustrated in FIGS. 2 and 3.

A first stage comminuting or subdividing subassembly is depicted in FIGS. 2, 3 and 4. This apparatus is skid mounted on elongated skid elements 32 which carry tow bars 34 at the opposite ends thereof for facilitating towing the apparatus by means of a suitable towing vehicle. The paraffinic material which has been accumulated in containers, such as 55 gallon drums, is deposited in a hopper 36 which is of generally frustoconical configuration. The hopper 36 funnels the paraffinic material to its restricted lower end where the paraffin is emptied into a relatively large diameter elongated receiving pipe 38. The pipe 38 may typically be about 10 inches in diameter, and carries a suitable union 40 at one end. The other end of the pipe 38 is open to facilitate the mounting in the pipe of a piston and cylinder subassembly hereinafter described. The union 40 is employed to receive and mount a paraffin extruder and cutter plate 42. The extruder and cutter plate 42 functions to subdivide the paraffin blocks and chunks into relatively small rods of limited length as the paraffin is forced through openings in the extruder-cutter plate.

For the purpose of forcing the paraffin through the openings in the extruder-cutter plate 42, a piston and cylinder subassembly 44 is provided and is illustrated in FIGS. 2 and 3. The piston and cylinder subassembly 44 includes an elongated tubular external piston 46 which carries a compression face 46*a* at its forward end. Secured to the inner side of the compression face 46*a* is a triangularly shaped attachment plate 48 to which is connected the forward end of a piston rod 50. The piston rod 50 has its other end connected to a piston (not visible) which is located inside a cylinder 52. The cylinder 52 is mounted by a suitable pivot pin 54 to the inner side of the pipe 38 near its open end. Power fluid is supplied to the cylinder 52 by a power fluid supply conduit 60 which is connected through a block valve body 62 to a hydraulic reservoir 64. The power fluid is returned from the cylinder by a return conduit 65. The hydraulic power fluid is pumped to the cylinder 52 by means of a hydraulic pump 66 which is driven through a suitable coupler 68 by an electric motor 70. The flow of hydraulic power fluid is controlled by a control valve 72.

In the operation of the described system, large chunks and blocks of paraffin from storage barrels are poured into the hopper 36. The paraffin gravitates downwardly until it enters the pipe 38 in the space ahead of the retracted piston 46 of the piston and cylinder subassembly 44. The hydraulic power fluid is then charged to the cylinder 52 by manipulation of the control valve 72, and this causes the piston rod 50 to be extended from the cylinder 52. As piston rod 50 is forced forward, the face 46a of the piston 46 encounters and forces the chunks and blocks of paraffin ahead of it. The paraffin is extruded through the multiple openings in the extruder-cutter plate 42. This subdivides or comminutes the paraffin blocks to provide a series of elongated spaghetti-like strings of the paraffin which are quite frangible, and which can be easily broken into particles of relatively short length.

Figure 5:
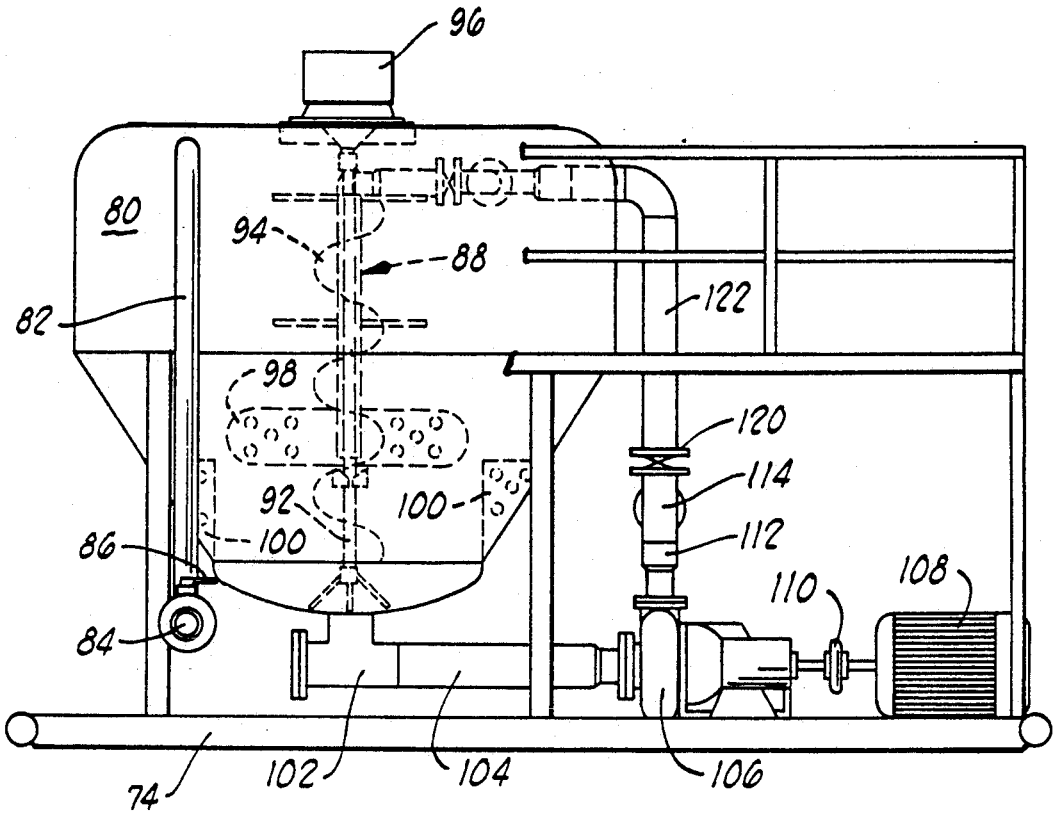
Figure 6:
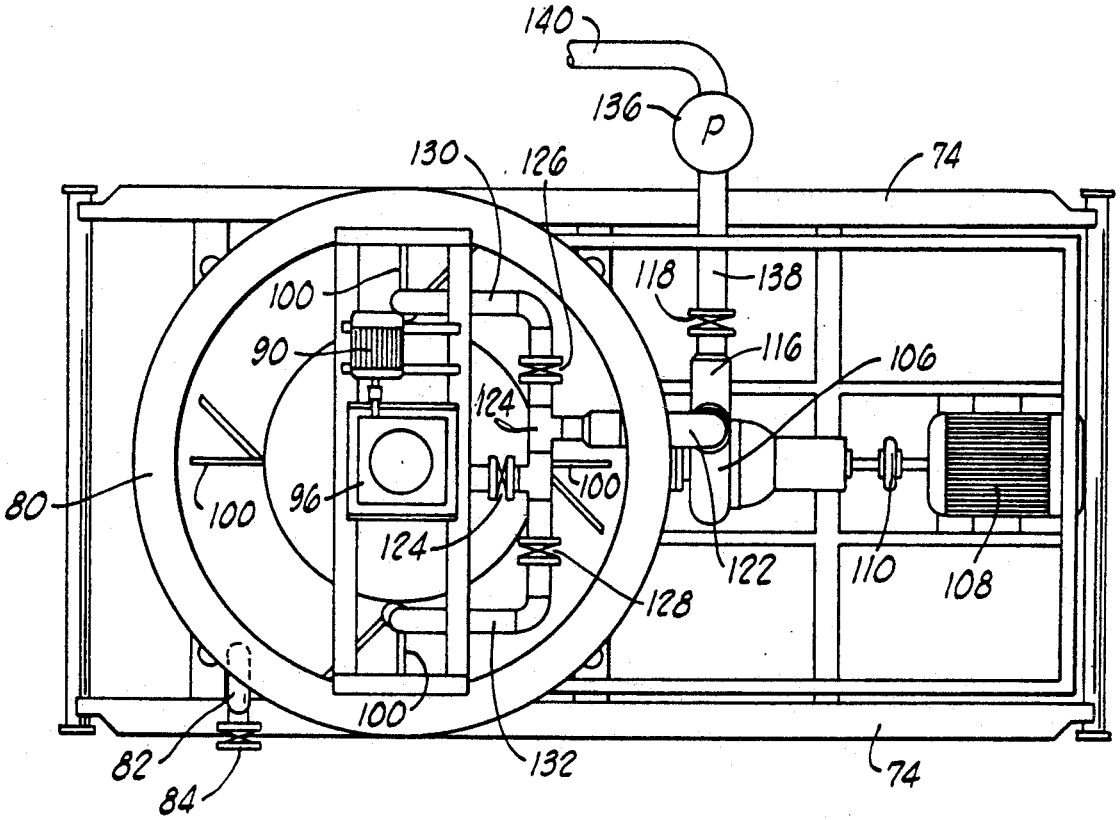
FIG. 6 is a top plan view of the apparatus depicted in FIG. 5.

The first stage comminuting subassembly will often be moved on the skids 32 to a location where it is in close proximity to a second stage comminuting and mixing subassembly. This second stage subassembly is shown in FIGS. 5 and 6. It, too, is mounted on skids or runners 74 and generally includes a container or mixing tank 80 and a mixing centrifugal pump by which the paraffin is placed in a final slurry form by mixture with a suitable crude oil or other selected hydrocarbon. Paraffin particles are moved by any suitable means, such as a screw or bucket conveyor, from the extruder-cutter plate 42 to the mixing tank 80.

In the mixing tank 80, the paraffin particles are mixed with a suitable liquid vehicle, such as crude oil or other similar liquid hydrocarbon, with which the paraffin is compatible, and which is compatible with the oil moving through a pipeline into which the paraffin slurry is to be reintroduced for disposal as hereinafter described. The oil with which the paraffin particles are mixed in the mixing tank 80 is input to the mixing tank via a feed line 82 having an inlet 84. The oil flow through the feed line 82 is controlled by a suitable valve 86. Within the mixing tank 80, a vertically extending auger-type stirrer subassembly 88 is mounted, and is powered by a suitable motor 90 which can typically be a 5 horsepower electric motor. The stirrer subassembly 88 includes an elongated shaft 92 which has a helical auger blade 94 turned therearound, as shown in FIG. 5, and is connected through a suitable gear box 96 at the upper side of the tank 80 to the motor 90. The stirrer subassembly 88 also includes a plurality of paddles 98 which function conjunctively with the auger blade 94 to agitate the mixture of paraffin particles and oil within the mixing tank 80. In the illustrated embodiment, four diverter baffle plates 100 are located at 90° from each other at circumferentially spaced intervals within the lower part of the mixing tank 80, and these function with the stirrer subassembly 88 in intimately mixing paraffin particles with the oil introduced to the tank via the feed line 82.

The intimate mixture of paraffin particles and oil is withdrawn from the bottom of the mixing tank 80 through a large diameter T-section 102, and is then passed through an eight inch suction pipe 104 to a centrifugal mixing and comminuting pump 106. The mixing and comminuting pump 106 is an important structural component of the second stage comminuting and mixing subassembly, and, indeed, of the entire system, and its overall function and mode of operation will be hereinafter described.

The centrifugal mixing and comminuting pump 106 is powered by a suitable electric motor 108, such as a 75 horsepower explosion proof electric motor. The motor 108 drives the pump 106 through a suitable coupling 110. The centrifugal comminuting and mixing pump 106 discharges through a discharge line 112 into a six inch diameter T-fitting 114. The T-fitting discharges either through a reducer section 116 (see FIG. 6) connected to a four inch discharge valve 118, or through a six inch block valve 120 into a six inch return circulation line 122.

The path through which the pumpable mixture discharged from the centrifugal pump 106 is directed will depend on the closure status of the valves 118 and 120. When a mixture of paraffin particles and oil is recirculated through the return circulation line 122, the mixture re-enters the mixing tank 80 near the top thereof, and the return flow of the mixture is passed through a tee 124 (see FIGS. 5 and 6) and is directed by a manifold according to whether either or both of a pair of gun line block valves 126 and 128 are closed. These gun line block valves 126 and 128 are provided in a pair of gun lines 130 and 132 which receive the mixture passing through the respective block valves 126 and 128 when these valves are totally or partially open, and direct the recirculated oil-wax mixture downwardly in the mixing tank on opposite sides thereof. The gun lines 130 and 132 are connected by elbows to downwardly extending legs which pass downwardly on opposite sides of the tank and end in nozzles. The gun lines 130 and 132 are typically located in a diametric plane containing the axis of the shaft 92 of the auger stirrer subassembly 88.

The mixture of paraffin particles and oil returned to the lower center of the mixing tank 80 via the two gun lines 130 and 132 is again mixed by the agitation developed by the stirrer subassembly 88. Such recirculation of the mixture continues as long as the centrifugal pump 106 is operated with the valve 118 closed and the valve 120 opened. As will be hereinafter explained, passage of the paraffin particles and the oil through the centrifugal pump 106 functions to further subdivide and reduce the particle size of the paraffin particles, and also increases the temperature of the mixture of oil and paraffins. This recirculation from the pump 106 to and through the mixing tank 80 is continued until a fairly uniform, relatively viscous slurry is generated in which small paraffin particles having a particle size in the range of from about 100 microns to about 900 microns are suspended in the oil. This slurry can then be pumped into an oil flowing pipeline for conveyance to a refinery which will process the mixed oil and slurry received from the pipeline.

For this purpose of injecting the wax-oil slurry into a pipeline for transport to a suitable refining site, an injection pump 136 is provided and is connected to the valve 118 by a four inch line 138. A high pressure oil resistant discharge line 140 is connected to the discharge of the injection pump 136, and can optionally be connected to a pig trap for re-injecting the slurry into the flowing oil, or can be connected directly into the pipeline, provided the injection pump develops sufficiently high pressure to effect such direct injection. The high pressure line 140 will preferably withstand pressures up to about 500 psi.

Figure 7:
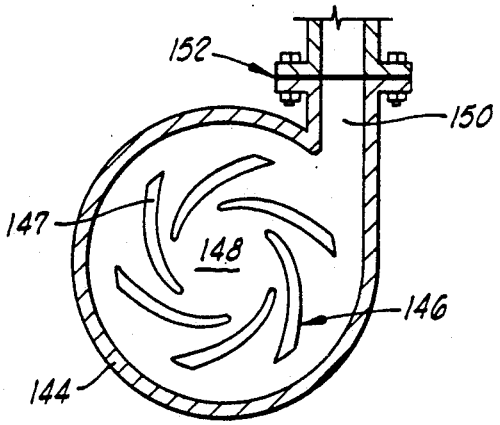
FIG. 7 is a view somewhat schematically illustrating the configuration of a type of centrifugal pump which is preferred for use in carrying out the method of present invention, and is a subassembly employed in the apparatus depicted in FIGS. 5 and 6.

As previously indicated, one of the most important structural components of the system is the centrifugal comminuting and mixing pump 106. The interior of this pump is illustrated in FIG. 7 of the drawings. The pump 106 has a generally cylindrical casing 144, which casing defines an interior space in which an interior impeller 146 is rotatably mounted. In the somewhat diagrammatic illustration of the centrifugal pump 106 in FIG. 7, the front of the generally cylindrical casing 144 has been removed in order to illustrate the type of impeller 146 utilized in the present pump. The impeller 146 has backwardly swept blades or vanes 147, and has an open face on one or both sides. By an open face is meant that over a major portion of the radial extent of the backwardly swept vanes of the impeller, there is no opposed side plate which lies in a plane extending normal to the axis of rotation of the impeller, and forms closed channels between the impeller fluid inlet area 148 and the blade tips at the radially outer end of each of the impeller blades or vanes 147.

The casing 144 has a tangential discharge passageway 150, and the pump 106 is connected through a suitable flanged connection 152 to the discharge line 112 hereinbefore described. A preferred type of pump for use as the centrifugal comminuting and mixing pump 106 is a centrifugal pump manufactured by the TRW Mission Manufacturing Company of Houston, Tex., and sold under the trademark "MISSION MAGNUM I". The concentric casing used in this type of centrifugal pump, as well as the backwardly swept configuration of the impeller blades, coupled with a larger inlet than outlet in the pump, provides superior performance in regard to reducing or further subdividing the size of the paraffin particles. This is accomplished primarily by a shearing action as the particles pass through the centrifugal pump when the pump is operated at a speed which is approximately 50% higher than the pump speed recommended where the pump is being used for conventional, substantially pure liquid applications. In the method of the present invention, the impeller may be typically rotated at from about 1200 RPM up to about 2500 RPM with about 1800 RPM being preferred. The paraffin particles are preferably reduced to a particle size of from about 100 microns to about 900 microns in diameter. The leading edge surface of each of the backwardly swept vanes or blades of the impeller 146 is preferably coated or faced with an abrasion-resistant coating, such as that provided under the trademark "SUPERLOY CLUSTER-RITE ®".

In the operation of the system, the extruded particles of paraffin wax from the extruder-cutter plate 42 are conveyed back to the mixing tank 80, and are introduced to this tank through its open top. Here, the paraffin particles are blended with crude oil or a mixture of hydrocarbons which has characteristics or properties which are similar to the oil moving in the pipeline which is to carry to a refinery site the paraffin-oil slurry developed by the system of the present invention. In the mixing tank 80, the stirrer subassembly 88, driven by the motor 90, functions to intimately mix the paraffin particles with the oil, and to effect a small amount of further subdivision of the paraffin particles. The principle further subdivision or reduction in the size of the paraffin particles occurs, however, in the centrifugal comminution and reduction pump 106. Here, the shearing action of the backwardly swept impeller blades, coupled with the cavitation occurring within the pump, cause a substantial further reduction in particle size so that the particles in general will be reduced to an average particle size of from about 100 microns to about 900 microns. More preferably, the average particle size is no greater than about 150 microns. The wax is also softened by this action.

With some types of hard paraffin wax or with some oils with which the wax is mixed, it may be desirable or even necessary to continue recirculating from the pump 106 into and through the mixing tank 80 until a slurry of the desired consistency is yielded. In such slurry, the wax particles will be sufficiently subdivided to assure their suspension in the oil as it moves through the pipeline toward the refinery. Once such slurry having the viscosity and other properties desired has been developed by such recirculation, the valve 120 can be closed and the valve 118 opened to allow the centrifugal pump 106 to discharge the slurry to the injection pump 136 which is a positive displacement pump capable of generating a high pressure discharge. The slurry is typically discharged from the centrifugal pump of from about 45 psi to about 60 psi. An injection pump which is satisfactory in a 100 horsepower to 165 horsepower triplex pump. From the injection pump 106, the slurry can be injected at high pressure directly into a flowing pipeline. Alternatively, it can be introduced to the pipeline at a lower pressure through a pig trap. In whichever method of introduction is used, the slurry, which has been heated to some extent by the agitation and shearing action to which it is subjected in the centrifugal pump 106, will be constituted so that the wax particles therein will remain suspended, and the slurry will be compatible with the crude oil or other hydrocarbon mixture moving through the pipeline toward a refinery which can be located at varying distances from the point of introduction of the slurry. Upon arrival at the refinery, the wax content of the oil moving in the pipeline is subjected to conventional crude oil treatment and refining procedures. By the described method, paraffin wax, once derived in impure and hazardous waste form from the pigging and cleaning of the pipeline, is converted into useful and valuable products. The wax has been converted to a form where it no longer poses any disposal problem or environmental hazard.

Although certain preferred embodiments of the present invention have been herein described in order to afford a better understanding of the invention which is adequate to allow its practice by those having skill in the art, it will be understood that various changes and innovations can be made in the described procedure and in the system used to carry it out, which changes and innovations come within the broad principles of the invention herein enunciated. Changes and innovations of this type are therefore deemed to be circumscribed by the spirit and scope of the invention as such is determined by a reasonably expansive interpretation of the appended claims.

What is claimed is:

1. A method of removing and disposing of wax buildup from a first pipeline, comprising:

(a) removing said wax buildup from said first pipeline in the form of paraffinic wax chunks;

(b) passing said paraffinic wax chunks through a first stage size reduction apparatus and thereby extruding said paraffinic wax chunks into spaghetti-like strings of paraffinic wax;

(c) after step (b), mixing said strings of paraffinic wax with a carrier oil to form a slurry;

(d) passing said slurry through a second stage size reduction apparatus wherein said slurry is subjected to a shearing action to further reduce the size of said strings of paraffinic wax into still smaller wax particles; and (e) pumping slurry discharged from said second stage size reduction apparatus into a receiving pipeline carrying a refinable petroleum oil for transport with said refinable petroleum oil to a refinery.

2. The method of claim 1, wherein:

in step (d), said second stage size reduction apparatus is a centrifugal pump.

3. The method of claim 1, wherein:

step (a) includes removing said wax buildup from said first pipeline by pigging said wax buildup from said first pipeline.

4. The method of claim 1, wherein:

said first pipeline from which said wax buildup is removed in step (a), and said receiving pipeline into which said wax particle and carrier oil slurry is pumped in step (e) are the same pipeline.

5. The method of claim 1, wherein:

in step (e), said wax particles in said slurry pumped into said receiving pipeline have an average size in a range of from about 100 microns to about 900 microns.

6. The method of claim 1, wherein:

in step (e), said wax particles in said slurry pumped into said receiving pipeline have an average size of less than about 900 microns.

7. The method of claim 6, wherein:

in step (e), said wax particles in said slurry pumped into said receiving pipeline have an average size of no greater than about 150 microns.

8. The method of claim 1, wherein:

in step (c), said carrier oil is a crude oil.

9. The method of claim 1, wherein:

in step (c), said carrier oil is the same oil as the refinable petroleum oil carried in said receiving pipeline.

10. The method of claim 1, further comprising:

(f) recirculating said slurry discharged from said second stage size reduction apparatus back through said second stage size reduction apparatus at least once.

11. The method of claim 10, wherein;

in step (c), said mixing is carried out in a mixing tank upstream of said second stage size reduction apparatus; and step (f) includes recirculating said slurry from a discharge of said second stage size reduction apparatus back to said mixing tank at least once.

12. The method of claim 1, wherein:

in step (e), said pumping is performed with a positive displacement pump which receives slurry discharged from said second stage size reduction apparatus.

13. The method of claim 1, further comprising:

between steps (a) and (b), temporarily storing said paraffinic wax chunks in barrels.

14. A method of removing and disposing of wax buildup from a first pipeline, comprising:

(a) pigging said first pipeline and thereby removing said wax buildup from said first pipeline in the form of hydrocarbon contaminated hard paraffinic wax chunks;

(b) extruding said paraffinic wax chunks into spaghetti-like strings of paraffinic wax;

(c) after step (b), mixing said strings of paraffinic wax with a carrier oil to form a string and carrier oil slurry;

(d) passing said string and carrier oil slurry at least once through a centrifugal pump;

(e) during step (d), shearing said strings of paraffinic wax in said centrifugal pump to break said strings into still smaller wax particles, thus forming a wax particle and carrier oil slurry; and (f) pumping said wax particle and carrier oil slurry with a second pump into a receiving pipeline carrying a refinable petroleum oil for transport with said refinable petroleum oil to a refinery.

* * * * *